United States Patent [19]

Carter et al.

[11] Patent Number: 5,038,424

[45] Date of Patent: Aug. 13, 1991

[54] MEDICAL MOBILITY SYSTEM

[75] Inventors: Thelma D. Carter, Kona, Hi.; Robert Gladwin, deceased, late of Wellesley, Mass., by Thelma D. Carter, administratrix

[73] Assignee: Carter Medical Corporation, Kona, Hi.

[21] Appl. No.: 568,843

[22] Filed: Aug. 17, 1990

[51] Int. Cl.[5] ..... A61G 7/10

[52] U.S. Cl. ..... 5/81 R; 5/81 B; 5/84; 5/88

[58] Field of Search ..... 5/81 R, 81 B, 81 C, 5/83, 84, 88, 61, 65

[56] References Cited

U.S. PATENT DOCUMENTS

| | | | |
|---|---|---|---|
| 716,886 | 12/1902 | Goode | 5/81 B |
| 2,528,048 | 10/1950 | Gilleland | 5/86 |
| 2,733,452 | 2/1956 | Tanney | 5/81 B |
| 3,108,290 | 10/1963 | Partridge | 5/88 |
| 3,383,717 | 5/1968 | Underwood | 5/88 X |
| 4,479,993 | 10/1984 | James | 5/61 X |
| 4,502,169 | 3/1985 | Persson | 5/61 X |
| 4,700,415 | 10/1987 | DiMatteo et al. | 5/81 R |
| 4,747,170 | 5/1988 | Knouse | 5/81 B |
| 4,776,047 | 10/1988 | DiMatteo | 5/81 R |
| 4,837,873 | 6/1989 | DiMatteo et al. | 5/81 R |
| 4,843,665 | 7/1989 | Cockel et al. | 5/65 |

*Primary Examiner*—Michael F. Trettel

*Attorney, Agent, or Firm*—Lerner, David, Littenberg, Krumholz & Mentlik

[57] ABSTRACT

A system for transferring a patient in a medical facility from one support surface to another support surface consists of a pliable web, the opposite ends of which are wound about a pair of cylindrical rollers. The cylindrical rollers are rotatably engaged between a drive motor and an idler bearing disposed on each longitudinal edge of one support so that the pliable web extends across substantially the entire surface thereof. A maneuverable table is similarly equipped on each longitudinal edge with a drive motor and idler bearing. The table is positioned alongside one edge of the one support and the cylindrical roller removed from between the drive motor and idler bearing at that edge of the one support and inserted between the drive motor and idler bearing on the remote edge of the table. As the drive motor on the remote edge of the table is actuated the cylindrical roller is rotated, thereby winding the web thereon and simultaneously transferring the patient from the one support to the table. The cylindrical roller on the remote edge of the one support can subsequently be removed therefrom and inserted between the drive motor and idler bearing on the near edge of the table. The table can then be maneuvered to any location in the medical facility as desired. Preferably, the drive motors are all of a hydraulic nature to permit the system to be safely operated in those areas of the medical facility where oxygen is in use.

16 Claims, 4 Drawing Sheets

MEDICAL MOBILITY SYSTEM

FIELD OF THE INVENTION

The present invention relates to a system for transporting patients from one station to another station in a medical facility and, in particular, to a device for transferring a patient between a mobile support and another support with a minimum amount of effort on the part of the person or persons handling the patient and with the least possible discomfort to the patient.

BACKGROUND OF THE INVENTION

The proper care of patients in a hospital or nursing home frequently requires that they be moved from their rooms to other locations in the facility, typically for procedures such as surgery, x-rays, or analytical testing. In those cases where the patient is non-ambulatory, such transfer requires the use of a wheelchair or a gurney. In order to transfer a patient from a bed or other support to a gurney, several personnel are needed either to lift the patient from the support onto the gurney or to pull on the patient's sheet to slide the patient laterally from the bed onto the gurney. This procedure is time consuming and difficult, especially for heavier patients and requires the medical facility to have at least several big, strong personnel on staff. Moreover, such procedures are frequently uncomfortable or even painful for more seriously injured patients, and may adversely affect their recovery.

A particular problem is faced in connection with patients that have been burned extensively. Such patients are repeatedly being moved for baths and skin grafting operations. Such repeated transfers typically instill fear and apprehension in these extensively burned patients as a result of the extreme discomfort and pain to which they are subjected.

Attempts have been made to provide devices which facilitate the transfer of a patient between a gurney and a bed. The prior art devices which have heretofore been available do not accomplish such transfer in the smoothest, most pain-free manner possible. Thus, for instance, U.S. Pat. Nos. 4,700,415 and 4,837,873 to DiMatteo et al., and U.S. Pat. No. 4,776,047 to DiMatteo disclose devices for transferring a prone patient between a bed and another horizontal support. In all of these devices, both the bed and the horizontal surface include webs which move independently of one another in a lateral direction to transfer the patient from the bed to the horizontal surface and back again. However, since the webs travel independently of one another and are in no way connected, the bed and the gurney must be separated from one another during the transfer operation so that the movement of one web does not interfere with the movement of the other web. The gap between the bed and the gurney creates a region in which the patient is not supported and, hence, the transfer of patients using these devices is not conducted in a smooth and comfortable fashion.

In the patient mover disclosed in U.S. Pat. No. 4,747,170 to Knouse, a web attaches to the edge of the sheet on the patient's bed so that as the web is wound onto a roller it pulls the sheet and the patient carried thereon onto an adjacent gurney. However, in order to return the patient to the bed it is necessary to repeat this process from the other side of the bed which may not be accessible for positioning the patient mover.

Thus, the need exists for an improved patient transferring device which will enable a patient to be transferred from one support surface to another support surface in a convenient and comfortable manner. There also exists a need for a system which cooperates with the patient transferring device to enable a patient to be transported from a support surface in one location of a medical facility to a support surface in a different location in a medical facility. Preferably, the patient transferring device will be simple to operate and maintain, and will cooperate with the other portions of the system to enable the transport of patients from one location to another to be accomplished in an efficient manner by a minimum of personnel.

SUMMARY OF THE INVENTION

In accordance with the present invention, these needs have now been addressed by the invention of an improved patient transfer system. The transfer system consists of first and second supports each having a support surface for receiving and supporting a patient; means for positioning one edge of the first support adjacent one edge of the second support; first and second cylindrical rollers; means for rotatably mounting the first cylindrical roller along an edge of the first support remote from the second support; means for rotatably mounting the second cylindrical roller along an edge of the second support remote from the first support; a pliable web having a first end connected to the first cylindrical roller and a second end connected to the second cylindrical roller, the pliable web adapted to be wound between the first and second cylindrical rollers; and drive means for rotating one of the first and second cylindrical rollers to transfer the patient from one of the first and second supports to another of the first and second supports. Preferably, the drive means are provided by hydraulic drive means.

In accordance with one embodiment of the system of the present invention, the drive means consists of first and second drive motors, the first drive motor operative to rotate the first cylindrical roller for transferring the patient from the second support to the first support, and the second drive motor operative to rotate the second cylindrical roller for transferring the patient from the first support to the second support. Both the first and second drive motors desirably are provided in the form of hydraulic drive motors. In a preferred embodiment, the pliable web is formed from a perforated material which will permit the passage of a liquid therethrough.

In accordance with another embodiment of the patient transfer system of the present invention, an intermediate panel is operatively connected to one of the first and second supports and disposed for engagement in assembled position with another of the first and second supports, wherein the intermediate panel lies below the pliable web when in this assembled position. In this embodiment, it is desirable that the intermediate panel be slidably disposed between a storage position beneath the one of the first and second supports and the assembled position.

In accordance with yet another embodiment of the present invention, a patient transfer system is provided consisting of first and second supports, each of the first and second supports having a support surface for receiving and supporting a patient; means for positioning one edge of the first support adjacent one edge of the second support; a first cylindrical roller rotatably mounted along the one edge of the first support and a second cylindrical roller rotatably mounted to the first support along an edge opposite the one edge; a pliable web having a first end connected to the first cylindrical roller and a second end connected to the second cylindrical roller, the pliable web adapted to be wound between the first and second cylindrical rollers; release means for releasing the first cylindrical roller from the one edge of the first support; means for rotatably mounting the first cylindrical roller to an edge of the second support remote from the first support; and first drive means for driving the first cylindrical roller to transfer the patient from the first support to the second support. In a preferred embodiment, the system also includes release means for releasing the second cylindrical roller from the first support and means for rotatably mounting the second cylindrical roller to the one edge of the second support. In a more preferred embodiment, the system further includes second drive means for driving the second cylindrical roller to transfer the patient from the second support to the first support. Both the first and second drive means are desirably provided by hydraulic drive means. In highly preferred embodiments, the pliable web is formed from a perforated material which will permit the passage of liquid therethrough.

Another aspect of the present invention provides a method for transferring a patient between first and second supports, the first support having first and second cylindrical rollers rotatably mounted along opposite edges thereof, at least the first cylindrical roller being releasably mounted thereon, and a pliable web connected between the first and second cylindrical rollers and disposed beneath the patient. According to the method, one edge of the second support is positioned adjacent one edge of the first support, and the first cylindrical roller is released from the first support and rotatably mounted along an edge of the second support remote from the first support, whereby the pliable web extends across the second support. As the first cylindrical roller is driven to wind the pliable web thereon, the patient is transferred from the first support to the second support. In preferred methods, the second cylindrical roller is released from the first support and mounted to the one edge of the second support.

In accordance with more preferred methods, the second cylindrical roller is released from the second support and rotatably mounted to an edge of the first support remote from the second support, whereby the pliable web extends across the first support. The second cylindrical roller is then driven to wind the pliable web thereon, thereby transferring the patient from the second support to the first support. In highly preferred methods, the first cylindrical roller is released from the second support and mounted to the one edge of the first support.

Still another aspect of the present invention provides a patient transfer table consisting of a support surface for receiving and supporting a patient; first and second cylindrical rollers; means for rotatably mounting the first and second cylindrical rollers along opposite edges of the support surface; a pliable web having a first end connected to the first cylindrical roller and a second end connected to the second cylindrical roller, the pliable web overlying the support surface and adapted to be wound between the first and second cylindrical rollers; release means for releasing the first cylindrical roller from the support surface for connection to another support; and first drive means for rotating the second cylindrical roller to thereby transfer the patient.

In accordance with one embodiment of this aspect of the present invention, the table further includes release means for releasing the second cylindrical roller from the support surface for connection to the other support. In preferred embodiments, the table also includes second drive means for rotating the first cylindrical roller to thereby transfer the patient. In more preferred embodiments, both the first and second drive means are provided by hydraulic drive means. In even more preferred embodiments, the pliable web is formed from a perforated material which will permit the passage of a liquid therethrough.

In accordance with another embodiment of the table of the present invention, an intermediate panel is operatively connected to the support surface and disposed for engagement in assembled position with the other support, wherein the intermediate panel lies below the pliable web when in this assembled position. In preferred embodiments, the intermediate panel is slidably disposed between a storage position beneath the support surface and the assembled position.

Preferred embodiments of the patient transfer system of the present invention provide a means for easily transferring a patient in a medical facility from one support to another support which can be performed by a minimum of personnel and which causes the least amount of discomfort for the patient. The patient transfer system is readily adaptable to be used in connection with conventional patient supports, such as hospital beds, x-ray tables, operating tables, bathtubs, etc. The apparatus which makes up the patient transfer system, including the patient transfer table, enables the preferred patient transfer methods of the present invention to be performed both comfortably and expeditiously, thereby eliminating the need for an excess of personnel and, at the same time, overcoming the patient's fear and apprehension of such transfers.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF A PREFERRED EMBODIMENT

Figure 1:
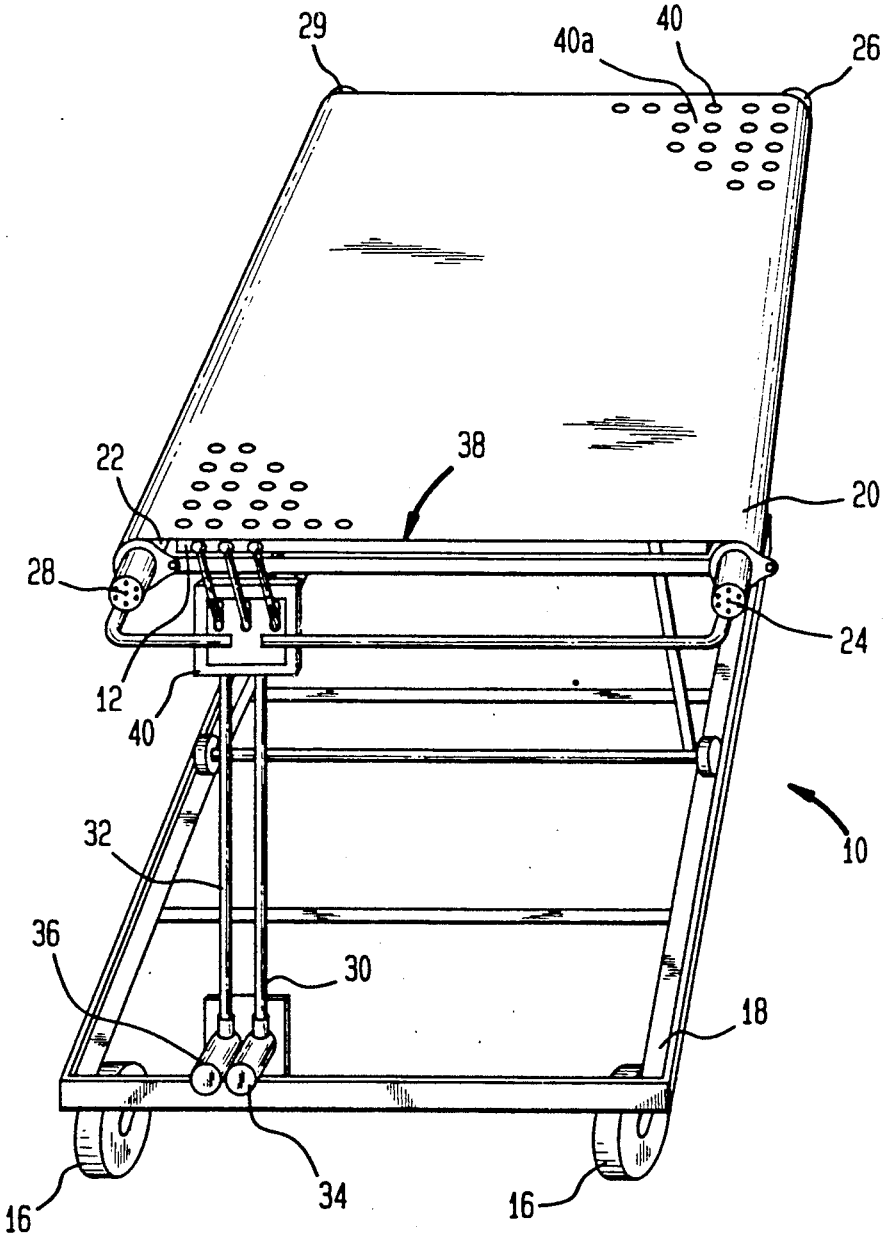
FIG. 1 is perspective view showing the patient transport table of the present invention.
Figure 2:
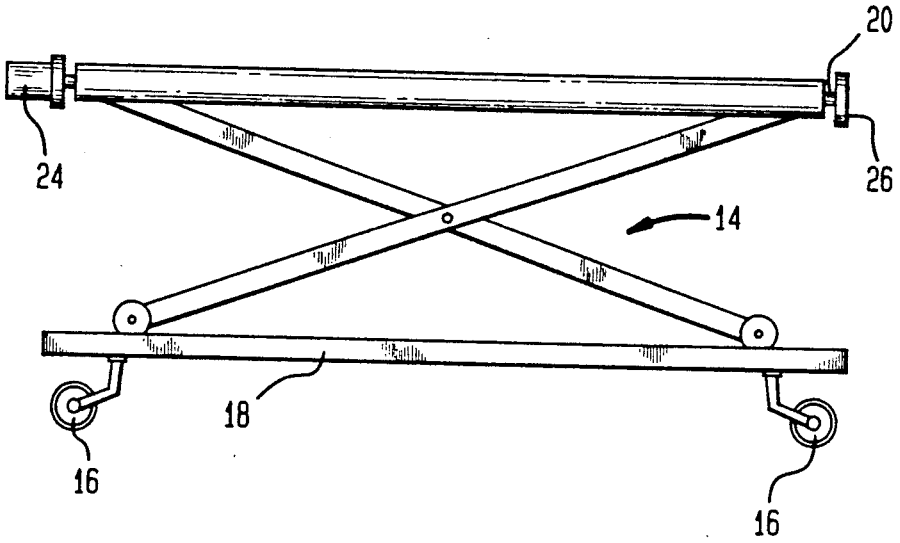
FIG. 2 is a side elevational view of the transport table shown in FIG. 1.

Referring to FIGS. 1 and 2, there is illustrated one preferred embodiment of the patient transport table 10 in accordance with the present invention. Table 10 has a planar support surface 12 with a rectangular cross-section sufficient in size to accommodate patients of varying size. Surface 12 is attached to an elevation system, indicated generally at 14, which may be actuated to raise or lower surface 12 to a desired height. Although a scissors type of system is shown in the figures, elevation system 14 may consist of any type of elevation system conventionally associated with hospital beds and gurneys. A plurality of wheels 16 attached to the bottom frame member 18 of the elevation system 14 permit table 10 to be rolled from one location to another location. Preferably, wheels 16 include a known type of locking mechanism which will prevent the accidental movement of table 10 once positioned.

Coextensive with the longitudinal edges of support surface 12, table 10 includes a pair of elongated rotatably mounted cylindrical rollers 20 and 22. At one end rollers 20 and 22 are positively driven, while at the other ends the rollers are merely supported for rotation. Thus, one end of roller 20 is connected to drive motor 24, while the opposite end is connected to idler bearing 26. Similarly, one end of roller 22 is connected to drive motor 28, while the opposite end is connected to idler bearing 29. As will be discussed hereinbelow, the connection of rollers 20 and 22 between the respective drive motors and idler bearings is such that rollers 20 and 22 may be readily disconnected therefrom for operative engagement between drive motors and idler bearings similarly situated on another support.

Figure 10:
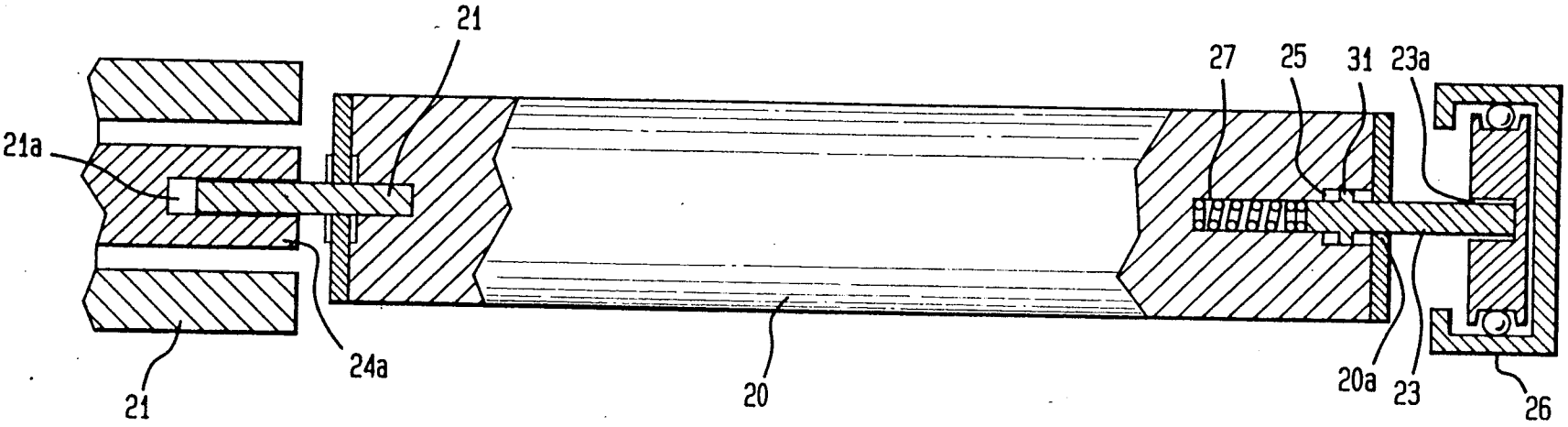
FIG. 10 is a partial, cross-sectional view of one cylindrical roller, showing the attachment thereof between a drive motor and idler bearing.

FIG. 10 shows the connection of cylindrical roller 20 between drive motor 24 and idler bearing 26. The connection of cylindrical roller 22 between drive motor 28 and idler bearing 29 is made in a similar fashion. Thus, as shown in FIG. 10, each end of roller 20 includes a pin having a hexagonal or other non-round cross-section. The pin 21 at one end of roller 20 will matingly engage with a recess 21*a* configured with a similarly shaped cross-section at the end of the shaft 24*a* of drive motor 24. The pin 23 at the opposite end of the roller 20 will matingly engage with a similarly shaped recess 23*a* configured on the axis of idler bearing 26. Preferably, one of pins 21 and 23 is fixedly mounted on roller 20, while the other pin is mounted on roller 20 in such a manner that it is axially retractable therein. Thus, as shown in FIG. 10, pin 21 is fixedly mounted at one end of roller 20, while pin 23 is slidably mounted in slot 25 at the other end of roller 20. A spring 27 mounted in slot 25 biases pin 23 outwardly from the end of roller 20. As pin 23 is biased outwardly, stop ring 31 engages the end 20*a* of roller 20 to prevent further outward movement of the pin.

In order to insert cylindrical roller 20 between drive motor 24 and idler bearing 26, retractable pin 23 is first axially aligned and engaged with recess 23*a* in idler bearing 26. The cylindrical roller 20 is then pushed towards the idler bearing 26 to retract pin 23 into slot 25. Pin 23 is retracted into slot 25 and cylindrical roller 20 moved towards idler bearing 26 until the free end of pin 21 may be axially aligned with recess 21*a* formed in the shaft 24*a* of drive motor 24. As the force applied to roller 20 is released, spring 27 biases roller 20 away from idler bearing 26 and, hence, pin 21 becomes engaged in recess 21*a*.

Drive motors 24 and 28 may be any type of high-torque motors capable of slowly rotating rollers 20 and 22 under a heavy load as described further below. As table 10 is typically used in a variety of hospital environments, it is preferable that drive motors 24 and 28, as well as all other drive motors, be hydraulically operated. The use of hydraulic motors instead of electric motors will permit the patient transport system of the present invention to safely operate in those areas of the hospital where oxygen is in use. The hydraulic power for operating the respective drive motors is supplied by hydraulic pumps, not shown, which are located throughout those areas of the hospital where table 10 is to be used. Thus, as table 10 is rolled into position for use, hydraulic supply and return lines from the hydraulic pump are connected to the hydraulic supply and return lines 30 and 32 of table 10 via quick disconnects 34 and 36. A series of control levers 38 connected to control panel 40 regulate the flow from the hydraulic pump in order to rotate either drive motor 24 or 28 as desired.

A pliable web 40 extends across substantially the entire length of support surface 12, and has a width which is several times the width of support surface 12. One end of web 40 is fastened to and wound about cylindrical roller 20, with the other end of web 40 fastened to and wound about cylindrical roller 22. Preferably, web 40 is formed from a strong, tear-resistant material, such as nylon, which will resist stretching under the weight of a patient. Such material is desirably perforated, as indicated at 40*a*, to enable any liquid situated on top of web 40 to drain therethrough. Additionally, web 40 is fastened to rollers 20 and 22 in a removable fashion, such as by snaps, clips, VELCRO or the like, thereby permitting web 40 to be replaced with a new web as cleaning or repair of web 40 become necessary. As drive motor 24 is actuated, web 40 will be unwound from cylindrical roller 22 and wound onto cylindrical roller 20. In a similar manner, actuation of drive motor 28 will cause web 40 to unwind from cylindrical roller 20 and wind onto cylindrical roller 22. The capability of each cylindrical roller to rotate in a direction to unwind web 40 as the other cylindrical roller is rotating in a direction to wind web 40 thereon may be provided by the particular construction of the drive motor, the cylindrical rollers themselves, or the connection between the two. Such capability is generally known in the art and is beyond the scope of the present invention.

Table 10 is most beneficially used in conjunction with an entire system for transporting patients from a support surface located in one area of a hospital to another support surface located in a different area of the hospital. For instance, table 10 may be used to transport a patient from a hospital bed in his room to an operating table, an x-ray table, or a bathtub located in another portion of the hospital. Table 10 is again used to return the patient from that remote location to his hospital bed. In a typical situation, the patient transport system will not be used throughout the entirety of the hospital, but will be operative in only selected locations therein. Thus, the system is usually installed in those areas of the hospital in which non-ambulatory patients, such as burn patients and patients with spinal injuries, are cared for.

Figure 3:
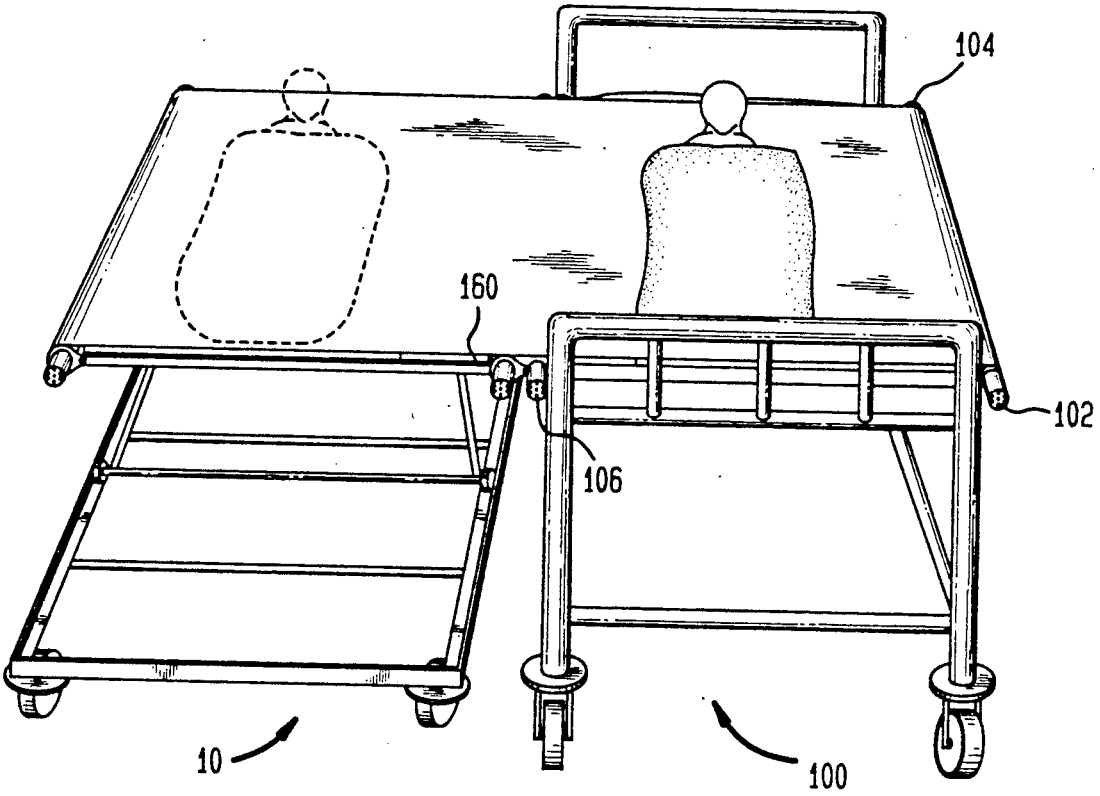
FIG. 3 is a perspective view of the transport table shown in FIG. 1 in operable engagement with a hospital bed in accordance with the present invention.

The system consists of several other components which interact to transfer a patient from a first support surface in the hospital to table 10 and subsequently to a second support surface. An important component of such system is the provision on each such support surface of a pair of drive motors and idler bearings arranged in a similar manner as they are on table 10. Thus, as shown in FIG. 3, a typical hospital bed 100 located in one of the selected areas of the hospital is fitted with drive motor 102 and idler bearing 104 along one longitudinal edge, and drive motor 106 and an idler bearing, not shown, along the opposite longitudinal edge. The drive motors and idler bearings on bed 100 will typically be of the same type as are used on table 10. Additionally, the distance between each drive motor and idler bearing on bed 100 is the same as that between each drive motor and idler bearing on table 10 so that bed 100 may readily accommodate cylindrical rollers 20 and 22. The connection of rollers 20 and 22 between the drive motors and idler bearings on bed 100 is preferably accomplished in the same manner as has been discussed above in connection with the connection of rollers 20 and 22 between the drive motors and idler bearings on table 10.

As another component of the system, each room having a hospital bed equipped with hydraulic drive motors and idler bearings is furnished with a hydraulic pump to supply the hydraulic power for operating the drive motors. Although not shown in the figures, the hospital bed is equipped with similar hydraulic supply and return lines and control levers as those used in connection with table 10, and which regulate the flow from the hydraulic pump to the drive motors. Since it is usually intended that the hospital bed be permanently positioned in the room, the hydraulic lines of the bed may be permanently connected to the hydraulic pump. Should more versatility or maneuverability be desired, the connection may be made via quick disconnects such as those used to connect the hydraulic pump to the hydraulic lines of table 10.

The other support surfaces in the hospital to which a non-ambulatory patient may be transferred, such as operating tables, x-ray tables, treatment tables, bath tubs for burn patients, etc., are also equipped with drive motors and idler bearings along their opposed longitudinal edges as is bed 100. In addition, the rooms in which these support surfaces are located are provided with hydraulic pumps which provide hydraulic power to the drive motors of the support surfaces as well as to table 10.

Operation of the patient transfer system can be more fully understood by reference to FIGS. 4–9. When a non-ambulatory patient is admitted to a hospital equipped with the system of the present invention, he will be placed in an appropriately equipped hospital room. The hospital room will include a hydraulic pump and a hospital bed, such as bed 100, equipped with drive motors and idler bearings. Before the patient is placed on bed 100, edge 110 of the bed will be fitted with cylindrical roller 20 between drive motor 102 and idler bearing 104, and edge 112 will be fitted with cylindrical roller 22 between drive motor 106 and the idler bearing at the opposite end of the bed. Pliable web 40, one end of which is wound about roller 20 and the other end of which is wound about roller 22, will thus extend across substantially the entire surface of bed 100. Hence, as the patient, shown schematically at P, is placed on the bed 100 he will be situated on top of pliable web 40.

Figure 4:
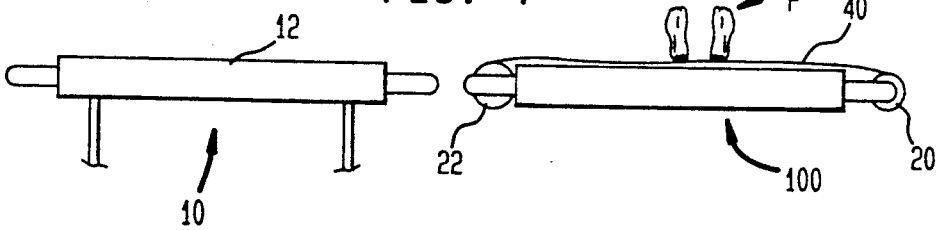
FIGS. 4–9 are highly schematic elevational end views showing the steps of moving a patient laterally from a stationary support to the transport table shown in FIG. 1.
Figure 5:
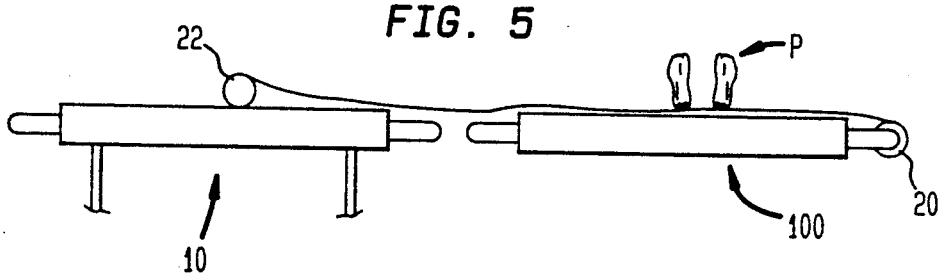
Figure 6:
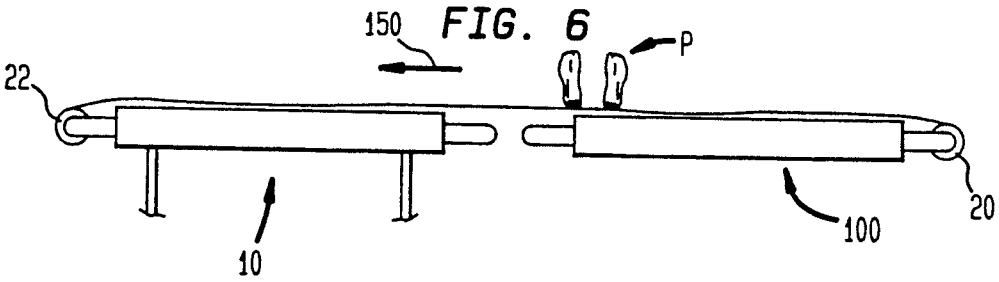
Figure 7:
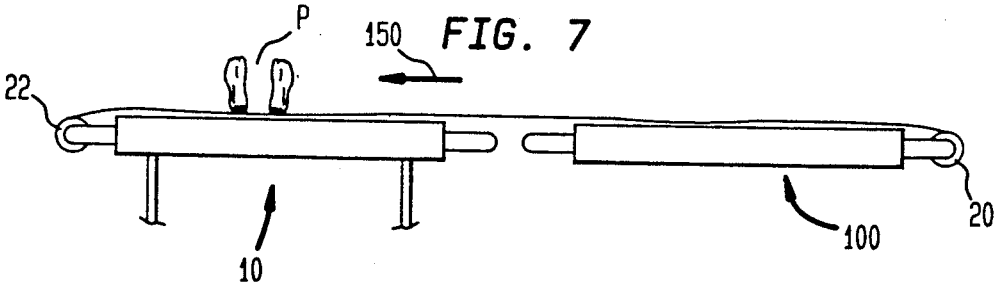
Figure 8:
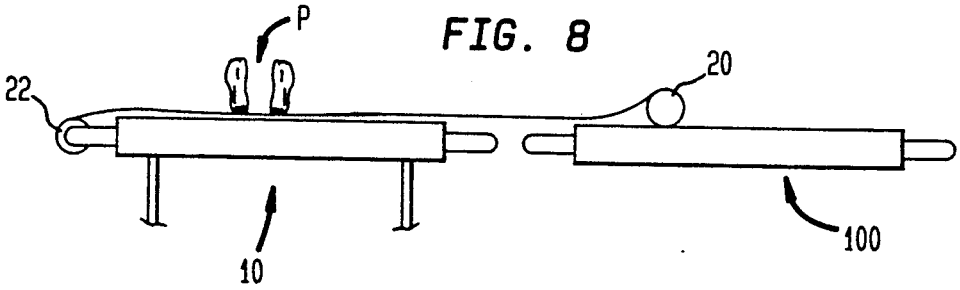
Figure 9:
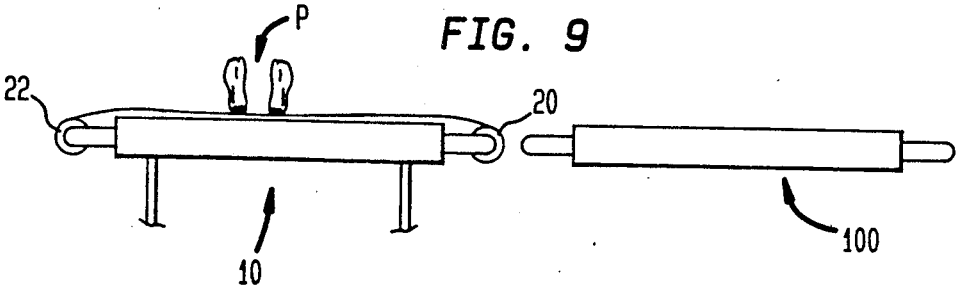

When it is necessary to transport a patient from hospital bed 100 to another location in the hospital, the patient is first transferred from bed 100 to table 10. In order to effectuate such transfer, table 10 is first positioned alongside edge 112 of bed 100 and adjusted by means of elevation system 14 until support surface 12 is at substantially the same height as the surface of bed 100, as shown in FIG. 4. Cylindrical roller 22 is then removed from between drive motor 106 and the idler bearing at the opposite end of bed 100 and pulled across the surface of table 10. Cylindrical roller 22 is wound with an excess of pliable web 40 so that as cylindrical roller 22 is extended across support surface 12 of table 10, pliable web 40 can be continually unwound therefrom, as shown in FIG. 5. As cylindrical roller 22 reaches the edge of table 10 remote from bed 100 it is inserted for rotation between drive motor 28 and idler bearing 29. By activating the hydraulic pump and operating the appropriate control levers 38 on table 10, drive motor 28 will be actuated to rotate cylindrical roller 22 in a counterclockwise direction, thereby winding pliable web 40 onto cylindrical roller 22 while unwinding pliable web 40 from cylindrical roller 20 on bed 100. As the actuation of drive motor 28 causes pliable web 40 to move in the direction of arrow 150, shown in FIGS. 6 and 7, patient P is smoothly and comfortably transferred from bed 100 to table 10. When such transfer is complete, cylindrical roller 20 is removed from between drive motor 102 and idler bearing 104 on bed 100 and manually rolled towards table 10, winding the excess of pliable web 40 thereon. When a sufficient amount of pliable web 40 has been wound on cylindrical roller 20, roller 20 is inserted for rotation between drive motor 24 and idler bearing 26 on table 10. Subsequently, table 10 may be disconnected from the hydraulic supply and return lines of the hydraulic pump. There being no further connections thereto, table 10 can now be rolled to the desired location in the hospital to which the patient is to be transferred. By positioning table 10 adjacent the support surface in this new location and repeating the steps discussed above in the reverse order the patient may be transferred from table 10 to the new support surface.

The provision of hospital bed 100 and all other support surfaces within the system with a drive motor 102 enables the patient P to be transferred from table 10 to any such support surfaces or back to his hospital bed 100 just as comfortably and efficiently as he was removed therefrom. Such procedure can be readily understood by referring to FIGS. 4–9 in reverse sequence. Thus, referring to FIG. 9, table 10 carrying patient P is positioned, for instance, alongside hospital bed 100 and adjusted to substantially the same height thereof. Cylindrical roller 20 is then removed from between drive motor 24 and idler bearing 26 on table 10, extended across the surface of bed 100 and rotatably mounted between drive motor 102 and idler bearing 104. The appropriate levers on bed 100 are then operated to actuate drive motor 102, thereby rotating cylindrical roller 20 in a clockwise direction. During such rotation, pliable web 40 moves in a direction opposite to arrow 150 in FIGS. 6 and 7, transferring patient P from table 10 to bed 100. When patient P is properly positioned on bed 100, cylindrical roller 22 is removed from between drive motor 28 and idler bearing 29 on table 10 and connected between drive motor 106 and the idler bearing at the opposite end of bed 100.

Providing operable drive motors on both longitudinal edges of table 10 facilitates the table's use in connection with the other support surfaces in the system. Thus, should a support surface, such as hospital bed 100, be disposed in close proximity to a wall or other structure so that table 10 cannot be positioned alongside one side thereof, table 10 merely need be positioned along the opposite side of bed 100 in order to transfer the patient thereto or therefrom. In other words, as depicted in FIGS. 4–9, if edge 112 of bed 100 were in close proximity to a wall, it would merely be necessary to position table 10 alongside edge 110 of bed 100. Hence, instead of attaching cylindrical roller 22 to the remote edge of table 10 in order to transfer patient P from bed 100 to table 10, cylindrical roller 20 would be connected to the edge of table 10 remote from bed 100 and drive motor 24 would be actuated to rotate cylindrical roller 20 in a clockwise direction, thereby transferring the patient to table 10 in a direction opposite that indicated by arrow 150. It will therefore be appreciated that equipping the opposite edge of bed 100 with drive motor 106 will enable the patient to be transferred from table 10 back to bed 100 when it is necessary to position table 10 alongside edge 110 of the bed.

Optionally, table 10 may be provided with a rigid connecting panel 160 which is conveniently stored beneath support surface 12. When a patient is being transferred between table 10 and hospital bed 100, connecting panel 160 is slid outward from beneath support surface 12 so that one edge engages the top edge of the surface of bed 100 while the other edge is disposed in a conventional manner in substantial alignment with support surface 12 on table 10. When engaged in this manner, connecting panel 160 will span any gap between table 10 and bed 100 and will be disposed beneath pliable web 40 as it spans from the far edge of table 10 to the far edge of bed 100. The presence of connecting panel 160 in the position described will provide additional support to prevent web 40 from sagging under the weight of patient P as he is transferred between table 10 and bed 100.

Although the invention herein has been described with reference to particular embodiments, it is to be understood that these embodiments are merely illustrative of the principals and applications of the present invention. For example, the drive motors and idler bearings may be arranged so that cylindrical rollers 20 and 22 are disposed along the lateral edges at the head and foot of the table and the other support surfaces so that a patient is transferred from one support surface to the next in the longitudinal direction. It is therefore to be understood that numerous modifications may be made to the illustrative embodiments and that other arrangements may be devised without departing from the spirit and scope of the present invention as set forth in the appended claims.

We claim:

1. A patient transfer system comprising, first and second supports, each of said first and second supports having a support surface for receiving and supporting a patient, means for positioning one edge of said first support adjacent one edge of said second support, first and second cylindrical rollers, means for rotatably mounting said first cylindrical roller along an edge of said first support remote from said second support, means for rotatably mounting said second cylindrical roller along an edge of said second support remote from said first support, a pliable web having a first end connected to said first cylindrical roller and a second end connected to said second cylindrical roller, said pliable web adapted to be wound between said first and second cylindrical rollers, first drive means permanently connected to said first support and operative to rotate said first cylindrical roller for transferring said patient from said second support to said first support, and second drive means permanently connected to said second support and operative to rotate said second cylindrical roller for transferring said patient from said first support to said second support.

2. A system as claimed in claim 1 wherein said first and second drive means comprise hydraulic drive means.

3. A system as claimed in claim 1 wherein said pliable web is formed from a perforated material which will permit the passage of a liquid therethrough.

4. A patient transfer system comprising, first and second supports, each of said first and second supports having a support surface for receiving and supporting a patient, means for positioning one edge of said first support adjacent one edge of said second support, first and second cylindrical rollers, means for rotatably mounting said first cylindrical roller along an edge of said first support remote from said second support, means for rotatably mounting said second cylindrical roller along an edge of said second support remote from said first support, a pliable web having a first end connected to said first cylindrical roller and a second end connected to said second cylindrical roller, said pliable web adapted to be wound between said first and second cylindrical rollers, drive means for rotating one of said first and second cylindrical rollers to transfer said patient from one of said first and second supports to another of said first and second supports, and an intermediate panel operatively connected to one of said first and second supports and disposed for engagement in assembled position with another of said first and second supports, wherein said intermediate panel lies below said pliable web when in said assembled position.

5. A system as claimed in claim 4 wherein said intermediate panel is slidably disposed between a storage position beneath said one of said first and second supports and said assembled position.

6. A patient transfer system comprising, first and second supports, each of said first and second supports having a support surface for receiving and supporting a patient, means for positioning one edge of said first support adjacent one edge of said second support, a first cylindrical roller rotatably mounted along said one edge of said first support and a second cylindrical roller rotatably mounted to said first support along an edge opposite said one edge, a pliable web having a first end connected to said first cylindrical roller and a second end connected to said second cylindrical roller, said pliable web adapted to be wound between said first and second cylindrical rollers, release means for releasing said first cylindrical roller from said one edge of said first support, means for rotatably mounting said first cylindrical roller to an edge of said second support remote from said first support, and first drive means for driving said first cylindrical roller to transfer said patient from said first support to said second support.

7. A system as claimed in claim 6 further comprising release means for releasing said second cylindrical roller from said first support and means for rotatably mounting said second cylindrical roller to said one edge of said second support.

8. A system as claimed in claim 6 further comprising,
second drive means for driving said second cylindrical roller to transfer said patient from said second support to said first support.

9. A system as claimed in claim 8 wherein said first and second drive means comprise hydraulic drive means.

10. A system as claimed in claim 6 wherein said pliable web is formed from a perforated material which will permit the passage of liquid therethrough.

11. A method for transferring a patient between first and second supports, said first support having first and second cylindrical rollers rotatably mounted along opposite edges thereof, at least said first cylindrical roller being releasably mounted thereon, and a pliable web connected between said first and second cylindrical rollers and disposed beneath said patient, said method comprising the steps of:
positioning one edge of said second support adjacent one edge of said first support,
releasing said first cylindrical roller from said first support,
rotatably mounting said first cylindrical roller along an edge of said second support remote from said first support, whereby said pliable web extends across said second support, and
driving said first cylindrical roller to wind said pliable web thereon, whereby said patient is transferred from said first support to said second support.

12. The method as claimed in claim 11, further comprising the steps of:
releasing said second cylindrical roller from said first support, and
mounting said second cylindrical roller to said one edge of said second support.

13. The method as claimed in claim 12, further comprising the steps of:
releasing said second cylindrical roller from said second support,
rotatably mounting said second cylindrical roller to an edge of said first support remote from said second support, whereby said pliable web extends across said first support, and
driving said second cylindrical roller to wind said pliable web thereon, whereby said patient is transferred from said second support to said first support.

14. The method as claimed in claim 13 further comprising the steps of:
releasing said first cylindrical roller from said second support, and
mounting said first cylindrical roller to said one edge of said first support.

15. A patient transfer table comprising,
a support surface for receiving and supporting a patient,
first and second cylindrical rollers,
means for rotatably mounting said first and second cylindrical rollers along opposite edges of said support surface,
a pliable web having a first end connected to said first cylindrical roller and a second end connected to said second cylindrical roller, said pliable web overlying said support surface and adapted to be wound between said first and second cylindrical rollers,
release means for releasing said first cylindrical roller from said support surface for connection to another support,
first drive means for rotating said second cylindrical roller to thereby transfer said patient, and
an intermediate panel operatively connected to said support surface and disposed for engagement in assembled position with said other support, wherein said intermediate panel lies below said pliable web when in said assembled position.

16. A table as claimed in claim 15 wherein said intermediate panel is slidably disposed between a storage position beneath said support surface and said assembled position.

* * * * *